United States Patent [19]

Hurd

[11] Patent Number: 4,732,075

[45] Date of Patent: Mar. 22, 1988

[54] ELASTOMERIC BUFFER UNIT FOR A WEAPON RECOIL SYSTEM

[76] Inventor: Bruce W. Hurd, 734 Navesink River Rd., Red Bank, N.J. 07701

[21] Appl. No.: 898,152

[22] Filed: Aug. 14, 1986

[51] Int. Cl.[4] ..... F41F 19/06

[52] U.S. Cl. ..... 89/44.02; 267/141.1; 267/152

[58] Field of Search ..... 42/74; 89/44.02, 198; 267/81, 83, 85, 141.1, 152, 153

[56] References Cited

U.S. PATENT DOCUMENTS

| | | | |
|---|---|---|---|
| 3,504,905 | 4/1970 | Irwin | 267/152 |
| 3,539,170 | 11/1970 | Hamel | 267/152 |

FOREIGN PATENT DOCUMENTS

| | | | |
|---|---|---|---|
| 1236420 | 6/1960 | France | 267/153 |
| 546525 | 7/1942 | United Kingdom | 267/141.1 |
| 983395 | 12/1982 | U.S.S.R. | 267/153 |

*Primary Examiner*—Stephen C. Bentley
*Attorney, Agent, or Firm*—Anthony T. Lane; Edwrd Goldberg; Edward F. Costigan

[57] ABSTRACT

Paired elastomeric elements, preferably made with silicone rubber, are separated by flat and preferably metallic separator elements which are parallel to each other when the elastomeric elements are not subjected to an external compressive load. The assembly of separator elements and elastomeric elements sandwiched therebetween in pairs is held between end plates intermediate a mass subjected to an external time-varying force, e.g. from an automatic weapon subjected to reaction forces from the projectiles being fired therefrom, and a support structure that is to be isolated from the time-varying forces. Each elastomeric element serves as both a spring and a damper, absorbing and dissipating absorbed energy to isolate a support structure from the full effect of the time-varying force from the weapon mounted thereon. The provision of elastomeric elements having different damping coefficients is particularly effective in eliminating the transmission of high frequency time-varying forces through the buffer unit. The effective stiffness of the elastomeric elements is increased significantly by the provision of closely spaced annular surrounding metal rings that constrain the lateral deformation of elastomeric elements subjected to significant compressive force.

8 Claims, 4 Drawing Figures

Fig. 1
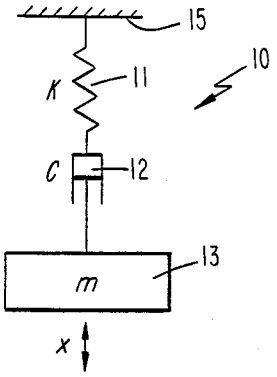
Fig. 2
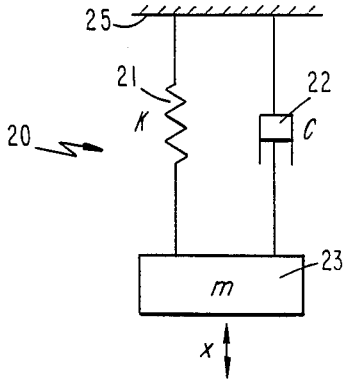
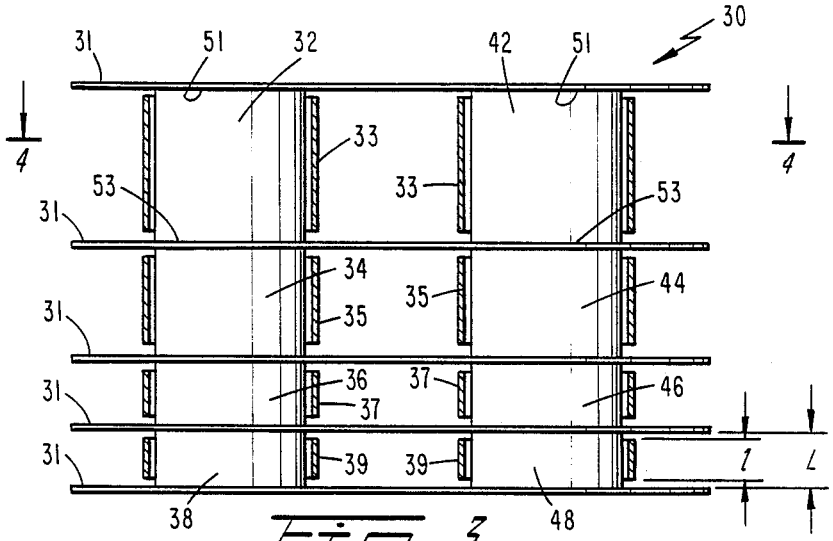
Fig. 3
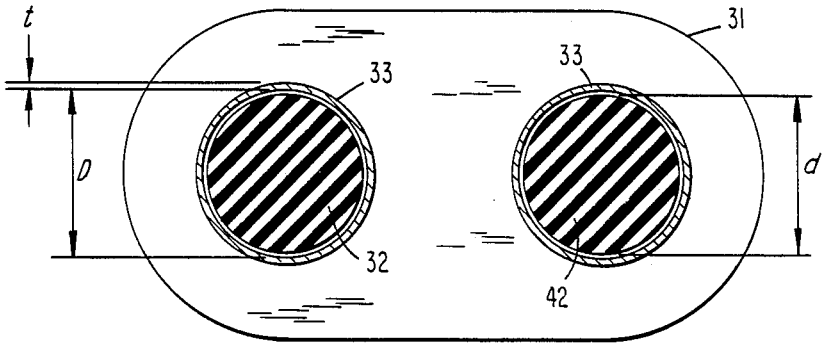
Fig. 4

ELASTOMERIC BUFFER UNIT FOR A WEAPON RECOIL SYSTEM

The invention described herein may be manufactured, used and licensed by or for the Government for Governmental purposes without the payment to me of any royalties thereon.

FIELD OF THE INVENTION

This invention relates generally to buffer units that absorb excess energy, e.g., received in the form of vibrations which are normally transmitted from a weapon to a supporting structure and, more particularly, to a compact buffer unit in which a plurality of stacked silicon rubber elements simultaneously store and dissipate vibrational energy.

HISTORY OF THE PRIOR ART

As more and more powerful automatic weapons are developed and deployed, it becomes important to develop efficient buffer units interposed between the weapon proper and the support structure to absorb the substantial amounts of incidental vibrational energy. The problem is that not only are new automatic weapons more powerful but they are also lighter and, therefore, experience greater accelerations. Reducing the weight of any weapon will consequentially increase the recoil force that must be absorbed by the weapon support structure.

From the perspective of classical solid mechanics, mechanical systems involving time-varying force inputs to a mass are conveniently represented by simplified mathematical models to develop an analytical understanding of the force absorption problem. Typically, there are three components in such a mechanical model of a real system: a spring (characterized by a generally constant spring stiffness k), a mass (generally a constant mass m), and a damper or a dash pot (characterized by a damping constant c). In the case at hand, the mass of the gun is essentially constant even if some ammunition is carried by the support structure. Therefore, the two parameters available in evaluating the design of a recoil mechanism are the spring constant k and the damping constant c. Usually, two separate units are required to perform the two separate functions, one unit being the spring and the other being a hydraulic damping system such as a shock absorber. Variations of such simple two-part systems have traditionally been used to buffer the recoil forces delivered by guns to their support structures. However, such systems tend to be heavy, complex, expensive, and not entirely reliable in prolonged use. Furthermore, to ensure satisfactory reliability, such mechanical-hydraulic systems must be maintained to rigorous standards, usually at considerable expense.

The use of rubber as a material is well-known in shock absorbers, soft gun mounts and buffer systems. These systems most commonly are loaded principally in shear. Also, such known systems apparently do not take full advantage of concepts such as stacking of elements having different shape factors, mounting of parallel stacks of materials with different damping coefficients, and tailoring of the damping coefficients to attain the most desirable dynamic response for particular conditions.

There is, therefore, a need for a relatively light, inexpensive, simple, unitary spring-damper unit that does not require significant maintenance during periods of prolonged storage or non-use.

SUMMARY OF THE INVENTION

Accordingly, it is an object of this invention to provide a single compact buffer unit capable of absorbing and dissipating significant quantities of vibrational energy.

It is another object of this invention to provide a light, compact, inexpensive buffer unit that can absorb and dissipate significant quantities of energy after prolonged storage without significant maintenance during non-use.

It is a further object of this invention to provide a light, compact, inexpensive, and easy-to-maintain buffer unit for absorbing and dissipating significant amounts of vibrational energy with an inherent ability to avoid resonance.

It is an even further object of this invention to provide a light, compact, inexpensive, easy-to-maintain buffer unit utilizing materials with two different damping coefficients to isolate a support structure from high frequency vibrational forces transmitted by a gun mounted thereon.

These and other objects of this invention are realized by providing apparatus in which, in a preferred embodiment, stacked pairs of silicon rubber button-like elements, separated in pairs by parallel aluminum plates, receive a time varying force at one end of the stack and absorb and damp out significant portions of the received energy to effectively mechanically isolate a support structure contacting the other end of the stack. In another aspect of this invention, improved damping of high frequency vibration and avoidance of resonance are obtained by utilizing two variations of silicon rubber having two different damping coefficients in adjacent stacks of the button-like silicon rubber elements. In yet another aspect of this invention, the spring constant of the unit is enhanced by surrounding the silicon button-like elements by annular metal rings that limit the amount of lateral deformation experienced by each button during use.

DESCRIPTION OF THE DRAWINGS

Other and further advantageous features of the present invention will hereinafter more fully appear in connection with the detailed description of the drawings, in which:

FIG. 1 is a schematic representation of the Maxwell model of a viscoelastic material providing energy absorption and dissipation to a mass subjected to a time-varying force.

FIG. 2 is a schematic representation of the Voight model of a viscoelastic material providing energy absorption and dissipation to a mass subjected to a time varying force.

FIG. 3 is a partially sectioned elevation side view of a preferred embodiment of the buffer unit of this invention.

FIG. 4 is a sectional plan view at section 4—4 of FIG. 3.

DESCRIPTION OF THE PREFERRED EMBODIMENT

The Maxwell model 10 of a time-varying, load-receiving viscoelastic material element is characterized in that it regards the spring component 11 of stiffness k as being in series with the damper component 12 having a damping coefficient c, both being in series with a mass 13 of magnitude m which is subjected to an external time varying force (not shown for simplicity) and is free to move in a direction x that is aligned with the spring 11 and the damper 12.

By comparison, the Voight model 20 of FIG. 2 is characterized in that the spring 21 of stiffness k and the damper component 22 having a damping coefficient c are connected in parallel to the mass 23 of magnitude m which is subjected to an external force (not shown for simplicity) and is free to move in a direction x.

While either the Maxwell or the Voight model may be useful for theoretical analysis for a buffer system utilizing viscoelastic materials, the most important fact worth noting is that rubber-like materials, especially the material commonly known as silicone rubber, has the features of both a spring and a damper.

At the molecular level, rubber can be visualized as long-chain molecules randomly arranged in a mass resembling spaghetti. The unkinking of these long-chain molecules under stress due to an externally applied force is responsible for the elastic or spring-like energy absorbing behavior of the rubber element. However, the friction generated by the physical displacement of adjacent long chain molecules in the elastomeric matrix also provides a damping component. The overall dynamic response of the material, when it is subjected to external vibrational force, is controlled by both its damping quality (internal friction) and elasticity (unkinking of the long chain molecules).

Of particular interest, in the present context, is the fact the composition of silicone rubber can be custom tailored to suit specific needs by the addition of controlled quantities of a silicone oil plasticizer in producing the silicone rubber. This silicone oil plasticizer affects the facility with which the long-chain molecules can slide past each other with more or less friction depending on the molecular weight of the oil, thus providing a silicone rubber material having a small or large damping capability.

As best seen in FIG. 3, a buffer unit 30 according to a preferred embodiment of this invention consists of a number of plates 31 which separate paired silicone rubber elements, e.g., 32–42, 34–44, 36–46, and 38–48. Each of these silicone rubber elements is conveniently formed in the shape of a right cylinder with a circular cross-section, although other shapes may be used. Plates 31 are preferably made of a metal, e.g. aluminium.

The height of each pair of elements progressively decreases from one end of the stacked unit to the other. This decrease in the heights of successive elements serves to effectively provide a spring that stiffens in response to increasing load. This is a feature that involves not only the properties of the silicone rubber material but also the geometry of each element.

To understand the influence of the element geometry on the mechanical functionality of the elastomeric elements, it is helpful to define a "shape factor" which is the ratio of the "loaded area" of an elastomeric element to the "force free area" for that element. In other words, the shape factor is the dimensionless number given by the sum of the surface areas of the top and the bottom of each of the elastomeric button-like elements subjected to the force of the weapon discharge divided by the surface area which is not loaded, in this case the circumference of the element times its height. By varying the shape factor, large changes in compressive modulus, i.e., the effective stiffness of the elastomeric element, can be achieved. Thus, for example, increasing the shape factor for a cylindrical elastomeric element from a dimensionless value of 1 to a value of 2 will augment the compressive modulus by approximately 300%. A preferred range for shape factor values is 0.5 to 4.0. The term "compressive modulus" in the present context may be regarded as analogous to Young's modulus for a perfectly elastic material in which stress is proportional to strain.

The generation of a stack of elastomeric elements, as best seen in FIG. 3, in which the heights of successive pairs of elements reduce from one side of the unit to the other as noted earlier, has the effect of producing a spring that stiffens with increasing load. As a force is applied to the buffer unit from one side, the elements with the largest length, i.e., elements 32 and 42 in FIG. 3, begin to deform to a barrel-shape. In other words, compression of elements 32 and 42 will tend to cause an increase in the element diameter midway between the ends being compressed.

As persons skilled in the art will appreciate, given the same mechanical properties and the same cross-sectional area, successive buttons subjected to the same external force will exhibit spring stiffnesses inversely proportional to their respective lengths. Therefore, an externally applied force acting compressively on aligned elastomeric elements 32, 34, 36 and 38 has the effect of significantly compressing the longest element 32 before significant deformation of the progressively shorter units 34, 36 and 38 is noticed. In effect, therefore, an increasing force initially encounters a relatively soft spring in element 32. Element 32 is significantly deformed and becomes effectively stiffer, transmitting the compressive force to a stiffer element 34 and to even stiffer elements 36 and 38 in progressive sequence. A useful property of silicone rubber, which adds to this spring stiffening effect, is the inherent nonlinearity of its compressive modulus, i.e., it does not behave like a perfectly elastic spring. When silicone rubber is compressed, it acts as a supralinear spring, i.e., one which progressively stiffens as it is deformed.

In the simplest embodiment of this invention, the end plates and the intermediate separating plates placed between adjacent silicone rubber elements are all similar and are preferably made of flat aluminum sheet metal of a shape best seen in FIG. 4. The entire assembly of flat aluminum plate elements 31 and buttons 32–38 and 42–48 is placed intermediate the gun mass and the support structure and the entire assembled unit is initially placed under a controlled compressive load.

Silicone rubber has a certain natural stickiness which tends to keep it in place attached to the aluminum plates 31, especially when subjected to a compressive force. In the simplest embodiment of this invention, therefore, no other complex or expensive elements are required to maintain the integrity of the assembly. Also, in the simplest embodiment of this invention, all the elastomeric elements are made of the same silicon rubber material. When the unit is subjected to external forces aligned along the axes of the cylindrical elastomeric elements 32–38 and 42–48, the various elastomeric elements act as springs in series, as discussed above, and absorb energy. Due to the internal friction within the elastomeric elements, a portion of the absorbed energy converts to heat which is communicated away to the ambient atmosphere through the thermally highly conductive aluminum plates 31 and free convection of air surrounding the aluminum plates and the silicone elements. Simultaneously, each elastomeric element elastically absorbs some mechanical energy which it releases when the external force oscilates back and forth.

It is known that the employment of two different damper elements in each pair, each with a different damping coefficient, serves to very effectively filter out transmitted vibration at high frequencies. This particular phenomenon can be utilized most effectively in the present invention by providing elastomeric elements 32–38 of a first elastomeric materials such as phenyl silicone having a first damping coefficient and elastomeric elements 42–48 of a second elastomeric material such as methylphenyl silicone having a second and different damping coefficient. The buffer unit thus constituted is very effective in filtering out high frequency vibrations. Another advantage in utilizing elastomeric elements of different damping coefficients is that each stack of elements 32–38 on one side and 42–48 on the other side, has a unique and different natural frequency. Resonance in the mechanical system is a catastrophic effect which occurs when the forcing frequency of the externally applied time-varying force, e.g., the cyclic rate of discharge of the mounted weapon, equals the natural frequency of the system. Because of the different resonant frequencies of the two parallel stacks of paired elastomeric elements 32–38 and 42–48, even if the time-varying input were to cause resonance of one of the elastomeric elements or one stack of elastomeric elements the other elastomeric elements will not respond equally and so will act to prevent the unit as a whole from becoming dangerously resonant. This is a particularly advantageous feature of such a compact and sturdy buffer unit.

The bulk modulus of a material is defined as the ratio of the triaxial tensile or compressive stress which is equal in all directions, e.g., hydrostatic pressure in a fluid, divided by the strain or ratio of the actual change in volume to the initial volume of an element of the material. As persons skilled in the art will appreciate, if elastomeric element 32 is subjected to compressive axial force and deforms in a barrel shape, so that its diameter intermediate its ends becomes larger, and a stiff annular cylindrical ring is provided close to and outside the cylindrical surface of the element, the lateral deformation of the element will be constrained and the material of the element will behave as if it had a very high spring stiffness k. In other words, it is the bulk modulus of the elastomeric material of element 32 which will decide the effective spring stiffness of the element. This feature may advantageously be utilized in yet another preferred embodiment of this invention, as best seen in FIGS. 3 and 4, by providing a set of optional annular ring-like cylinders 33–39 for each set of elastomeric elements 32–38 and 42–48. As best seen in FIG. 4, the internal diameter D of annular cylindrical ring 33 is slightly larger than the unloaded external diameter of the typical elastomeric element 32. Elements 33–39 are preferrably made of a metal, e.g., stainless steel or aluminum to avoid corrosion during prolonged exposure, and provide the requisite strength with a relatively small thickness t. This ensures that the entire unit is not unduly heavy.

If the unloaded length of a pair of elastomeric elements, e.g., 38 and 48 in FIG. 3, is L then the length 1 of each of corresponding annular ring-like retaining elements 39 must be somewhat smaller. The key is that when the elastomeric elements 38 and 48 are under maximum load the ring-like element 39 must not be in simultaneous contact with both of the adjacent separator and/or end elements 31. A similar logic is applied in selecting the lengths of the other ring-like retaining annular elements 33–37. Persons skilled in the art can be expected to size the elastomeric elements and the ring-like retainer elements in light of the particularized needs being met by a buffer unit 30 in use. Typically, for elastomeric elements having diameters of the order of two to three inches, a radial clearance of approximately 1/16th of an inch between the unloaded outside of the elastomeric element and the inner surface of the annular ring-like element 33 is adequate. Likewise, for elastomeric elements of a length of two to three inches, the corresponding ring-like retaining element 33 should be approximately half an inch shorter where the elastomeric element is made of silicone rubber.

As noted earlier, most silicone rubbers have a certain amount of natural stickiness which allows an assembly of aluminium separator plates 31 and stacks of elastromeric elements 32–38 and 42–48 to retain their physical integrity once the buffer unit 30 is in place and subjected to a compressive preload. The addition of a time-varying compressive force superimposed on the compressive preload will not cause the elastomeric elements to wander. However, for convenience in storage and transport between the manufacturing location and the point of use, any easily applied elastic adhesive may be provided in a very thin layer at the ends of the elastomeric elements so that they will stay in place with respect to aluminium separator plates 31.

Finally, it should be noted that for particular uses it may be necessary to have the end plates of somewhat different geometry than the essentially flat planar separator plates 31 between elastomeric elements.

It should be apparent from the preceding that this invention may be practiced otherwise than as specifically described and disclosed herein. Modifications, therefore, may be made to the specific embodiments disclosed here without departing from the scope of this invention, and are intended to be included within the claims appended below.

What is claimed is:

1. An elastomeric buffer unit for a weapon recoil system, comprising:

a plurality of paired elastomeric elements, disposed successively as pairs such that a first element of each pair is aligned with a first reference axis and a second element of each pair is aligned with a second reference axis;

said first and second members of said paired elastomeric elements are comprised of first and second elastomeric materials, respectively;

a plurality of separator elements, of which individual separator elements are disposed alternating between and in simultaneous contact with adjacent pairs of said plurality of aligned paired elastomeric elements; and first and second end elements, disposed outwardly of and in contact with a first and a last pair, respectively, of said plurality of successively aligned paired elastomeric elements, said first and second end elements being subjected during use to an initial compressive preload and a time-varying load such that both said preload and a time-varying load are transmitted between said first and second end elements through said plurality of paired elastomeric elements and said separator elements therebetween.

2. The buffer unit of claim 1 wherein said first elastomeric material is phenyl silicone, and said second elastomeric material is methyl phenyl silicone.

3. An elastomeric buffer unit for a weapon recoil system, comprising:

a plurality of paired elastomeric elements, disposed successively as pairs such that a first element of each pair is aligned with a first reference axis and a second element of each pair is aligned with a second reference axis;

said first and second members of said paired elastomeric elements are comprised of first and second elastomeric materials, respectively;

a plurality of separator elements, of which individual separator elements are disposed alternating between and in simultaneous contact with adjacent pairs of said plurality of aligned paired elastomeric elements; and first and second end elements, disposed outwardly of and in contact with a first and a last pair, respectively, of said plurality of successively aligned paired elastomeric elements, said first and second end elements being subjected during use to an initial compressive preload and a time-varying load such that both said preload and said time-varying load are transmitted between said first and second end elements through said plurality of paired elastomeric elements and said separator elements therebetween;

deformation limiting means, disposed around at least one constrained elastomeric element of said buffer unit, whereby deformation of said elastomeric unit under the action of said preload and said time-varying load is constrained.

4. The buffer unit of claim 3 wherein said first elastomeric material is phenyl silicone, and said second elastomeric material is methyl phenyl silicone.

5. An elastomeric buffer unit for a weapon recoil system, comprising:

a plurality of paired elastomeric elements, disposed successively as pairs such that a first element of each pair is aligned with a first reference axis and a second element of each pair is aligned with a second reference axis;

said first and second members of each pair of said paired elastomeric elements are comprised of first and second elastomeric material respectively;

said elastomeric elements all have the same cross-sectional area normal to whichever one of said first or second reference axes each of said elastomeric elements is aligned with;

said successive pairs of said elastomeric elements are disposed in order of a dimension measured along one of said reference axes;

for each of said elastomeric elements the dimensionless shape factor, defined as net loaded area divided by net force-free area, is in the range between 0.5 and 4;

a plurality of separator elements, of which individual separator elements are disposed alternating between and in simultaneous contact with adjacent pairs of said plurality of aligned paired elastomeric elements; and first and second end elements, disposed outwardly of and in contact with a first and a last pair, respectively, of said plurality of successively aligned paired elastomeric elements, said first and second end elements being subjected during use to an initial compressive preload and a time-varying load such that both said preload and said time-varying load are transmitted between said first and second end elements through said plurality of paired elastomeric elements and said separator elements therebetween.

6. The buffer unit of claim 5 wherein said first elastomeric material is phenyl silicone, and said second elastomeric material is methyl phenyl silicone.

7. An elastomeric buffer unit for a weapon recoil system, comprising:

a plurality of paired elastomeric elements, disposed successively as pairs such that a first element of each pair is aligned with a first reference axis and second element of each pair is aligned with a second reference axis;

said first and second members of each pair of said paired elastomeric elements are comprised of first and second elastomeric materials, respectively;

said elastomeric elements all have the same cross-sectional area normal to whichever one of said first and second reference axes each of said elastomeric elements is aligned with;

said successive pairs of said elastomeric elements are disposed in order of a dimension measured along one of said reference axes;

each of said elastomeric elements is shaped as a right circular cylinder;

each of said elastomeric elements having a dimensionless shape factor, defined as net loaded area divided by net force-free area; in the range between 0.5 and 4;

a plurality of separator elements, of which individual separator elements are disposed alternating between and in simultaneous contact with adjacent pairs of said plurality of aligned paired elastomeric elements; and said separator elements and said end elements comprise aluminum.

first and second end elements, disposed outwardly of and in contact with a first and a last pair, respectively, of said plurality of successively aligned paired elastomeric elements, said first and second end elements being subjected during use to an initial compressive preload and a time-varying load such that both preload and said time-varying load are transmitted between said first and second end elements through said plurality of paired elastomeric elements and said separator elements therebetween;

deformation limiting means, disposed around each constrained elastomeric element of said buffer unit, whereby deformation of said elastomeric unit under the action of said preload and said time-varying load is constrained;

said deformation limiting means comprises an annular cylindrical band disposed around a non-loadbearing surface of said constrained elastomeric element, said band being sized to provide a first predetermined clearance around said constrained elastomeric element in the absence of said time-varying force and also a second predetermined longitudinal clearance normal to a separator element contacting said constrained elastomeric element.

8. The buffer unit of claim 7 wherein said first elastomeric material is phenyl silicone, and said second elastomeric material is methyl phenyl silicone.

* * * * *